US005400737A

United States Patent [19]

Salazar

[11] Patent Number: 5,400,737

[45] Date of Patent: Mar. 28, 1995

[54] FLAGSTAFF WITH HAND SALUTE FIGURE

[76] Inventor: John D. Salazar, 8101 Russell Rd., Alexandria, Va. 22309

[21] Appl. No.: 137,962

[22] Filed: Sep. 27, 1993

[51] Int. Cl.[6] ..... G09F 17/00; E04H 12/18; E04H 12/32

[52] U.S. Cl. ..... 116/174; 116/173; 52/726.3; 52/720

[58] Field of Search ..... 40/218, 419; 52/720, 52/726.1, 726.3; 116/173, 174; 248/521; 403/111, 149

[56] References Cited

U.S. PATENT DOCUMENTS

| | | | |
|---|---|---|---|
| 193,930 | 8/1877 | Davies et al. | 40/419 X |
| 689,077 | 12/1901 | Griffith . | |
| 711,510 | 10/1902 | Little | 40/419 X |
| 716,698 | 12/1902 | Warner . | |
| 822,405 | 6/1906 | Teese | 52/720 X |
| 862,864 | 8/1907 | Corthell . | |
| 908,734 | 1/1909 | Brown | 40/419 X |
| 1,061,041 | 5/1913 | Buckley . | |
| 1,257,865 | 2/1918 | Holmes | 40/218 |
| 1,429,506 | 9/1922 | Herr . | |
| 2,105,904 | 1/1938 | Dale | 40/419 X |
| 2,458,316 | 1/1949 | Swertlow | 116/173 |
| 2,674,989 | 4/1954 | Morsch . | |
| 2,693,980 | 11/1954 | Heidman, Jr. | 403/111 X |
| 2,853,046 | 9/1958 | Meade . | |
| 2,870,559 | 1/1959 | Shaughnessy | 116/173 |
| 3,225,734 | 12/1965 | Bule . | |
| 3,417,732 | 12/1968 | Platt, Jr. | 116/173 |
| 3,418,967 | 12/1968 | Donkersloot . | |
| 3,587,520 | 6/1971 | Miller | 116/173 |
| 3,595,202 | 7/1971 | Visitacion . | |
| 3,675,616 | 7/1972 | McInnis | 116/173 |
| 4,103,642 | 8/1978 | Swenson . | |
| 4,217,738 | 8/1980 | Smith . | |
| 4,228,627 | 10/1980 | O'Neill . | |
| 4,554,885 | 11/1985 | Burney, Jr. . | |
| 4,603,652 | 8/1986 | Thibault et al. . | |
| 4,800,834 | 1/1989 | Feng | 116/173 |
| 4,944,656 | 7/1990 | Feng et al. | 116/173 |
| 4,949,525 | 8/1990 | Weaver . | |
| 5,050,356 | 9/1991 | Johnson et al. . | |
| 5,063,719 | 11/1991 | Matsuo et al. . | |

*Primary Examiner*—Carl D. Friedman
*Assistant Examiner*—Kevin D. Wilkens

[57] ABSTRACT

A flagstaff including upper and lower end portions each having upper and lower ends. The lower end of the upper end portion is downwardly telescoped into and rotatably received in the upper end of the lower end portion and includes lanyard structure for raising and lowering a flag relative to the upper end portion. The lower end of the upper end portion is yieldingly biased toward an upper position from a lower limit position and first rotary coupling structure releasbly latches the upper end portion to the lower end portion against upward removal therefrom. When the upper end portion is latched to the lower end portion it is slightly downwardly depressed from the upper position to which it is yieldingly biased and the lower end portion includes a human simulating figure including an articulated right arm shiftable between a downwardly extending, position and a hand salute position and yieldingly biased toward the downwardly extending position. Actuating structure is provided for overcoming the biasing action on the right arm and moving the right arm from the lowered postion to the hand salute position as the upper end portion is shifted toward its lower limit position.

9 Claims, 4 Drawing Sheets

FLAGSTAFF WITH HAND SALUTE FIGURE

BACKGROUND OF THE INVENTION

1. Field of the Invention

This invention relates to a flagstaff including a stationary lower end portion and an upper end portion removably supported from the upper end of the lower end portion. The upper end portion is rotable relative to the lower end portion and supports halyard structure for supporting, raising and lowering a flag on the upper end portion. A rotatable coupling is provided between the upper and lower end portions preventing their separation, but still allowing rotation of the upper end portion relative to the lower end portion. Further, the lower end portion includes a human figure supported therefrom including an articulated right arm movable between a downwardly directed, along the corresponding body side, position and a hand salute position. Further, the lower end portion includes structure for actuating the figure upon downward telescoping engagement of the upper end portion in the upper end of the lower end portion in order to move the right arm of the figure from the downwardly directed position to the hand salute position.

2. Description of Related Art

Various different forms of flagstaffs including some of the general structural and operational features of the instant invention heretofore have been provided. Examples of these previously known devices are disclosed in U.S. Pat. Nos. 689,077, 716,968, 862,864, 1,061,041, 1,429,506, 2,674,989, 2,853,046, 3,225,734, 3,418,967, 3,595,202, 4,103,642, 4,217,738, 4,228,627, 4,554,885, 4,603,652, 4,949,525, 5,050,346, and 5,063,719. However, these previously known devices do not include the overall combination of structural and operational features of the instant invention.

SUMMARY OF THE INVENTION

The flagstaff of the instant invention is designed to be used primarily by a homeowner and includes upper and lower end portions with the lower end portion being adapted to be stationarily mounted in the ground. The upper end portion of the flagstaff includes a lower end which may be downwardly telescoped into the upper end of the lower end portion in a manner such that the upper end portion is rotatable relative to the lower end portion. The upper end portion includes halyard structure thereon for supporting a flag and raising and lowering a flag relative to the upper end portion. Furthermore, rotary coupling structure is provided between the adjacent ends of the upper and lower end portions latching the upper end portion to the lower end portion against separation therefrom while still allowing rotation of the upper end portion relative to the lower end portion.

By allowing the upper end portion of the flagstaff from which the flag is supported to rotate relative to the lower end portion, the upper end portion, because of the pull on the associated flag thereon, will rotate as the wind direction changes such that the flag is substantially always in a downwind position relative to the upper end portion. Hence, the furling of the flag about the portion of the flagstaff from which it is supported will be substantially eliminated.

Also, the lower end portion of the flagstaff includes a human simulating figure supported therefrom including an articulated right arm which is moveable between a lowered position extending downwardly along the corresponding side of the figure and a raised hand salute position. The right arm is yieldingly biased toward the lower position and the lower end portion of the flagstaff includes actuating structure engageable by the lower end of the upper end portion of the flagstaff as it is downwardly telescoped into the upper end of the lower end portion of the flagstaff for causing the articulated arm to move to the hand salute position.

The main object of this invention is to provide a flagstaff including a rotatable upper end portion having halyard structure supported therefrom for support of a flag from the upper end portion and for raising and lowering the flag relative to the upper end portion whereby the flag will substantially always be on the downwind side of the upper end portion of the flagstaff even when the wind direction changes.

Another object of this invention is to provide a flagstaff in accordance with the preceding object and including a human simulating figure on the lower end portion of the flagstaff with the figure equipped with an articulated right arm moveable between a downwardly directed lowered position and a raised hand salute position and with the upper end portion of the flagstaff being partially downwardly telescopingly engageable within the upper end of the lower end portion of the flagstaff for engaging actuating structure for the right arm of the figure and for causing the right arm of the figure to shift from the lowered position to the raised hand salute position as the upper end portion of the flagstaff is telescoped downwardly into the upper end of the lower end portion of the flagstaff.

A still further object of this invention is to provide a flagstaff having a removable upper end portion from which the associated flag is flown and around which the associated flag may be rolled upon removal of the upper end portion of the flagstaff from the lower end portion thereof, thereby providing a convenient means of storing the flag during the hours it is not being flown.

Yet another important object of this invention is to provide a flagstaff in accordance with the preceding objects and including a small wind vane on the upper extremity of the upper end portion thereof to thereby enable the upper end portion of the flagstaff to rotate relative to the lower end portion of the flagstaff even in light winds as the wind direction changes.

A further object of this invention is to provide a flagstaff including a removable upper end portion and a cap loosely tethered to the upper end of the lower end portion removably securable over the upper end of the lower end portion when the upper end portion of the flagstaff is removed.

A final object of this invention to be specifically enumerated herein is to provide a flagstaff in accordance with the preceding objects and which will conform to conventional forms of manufacture, be of simple construction and easy to use so as to provide a device that will be ecconomically feasible, long-lasting and relatively trouble-free in operation.

These together with other objects and advantages which will become subsequently apparent reside in the details of construction and operation as more fully hereinafter described and claimed, reference being had the accompanying drawings forming a part hereof, wherein like numerals refer to like parts throughout.

Figure 1:
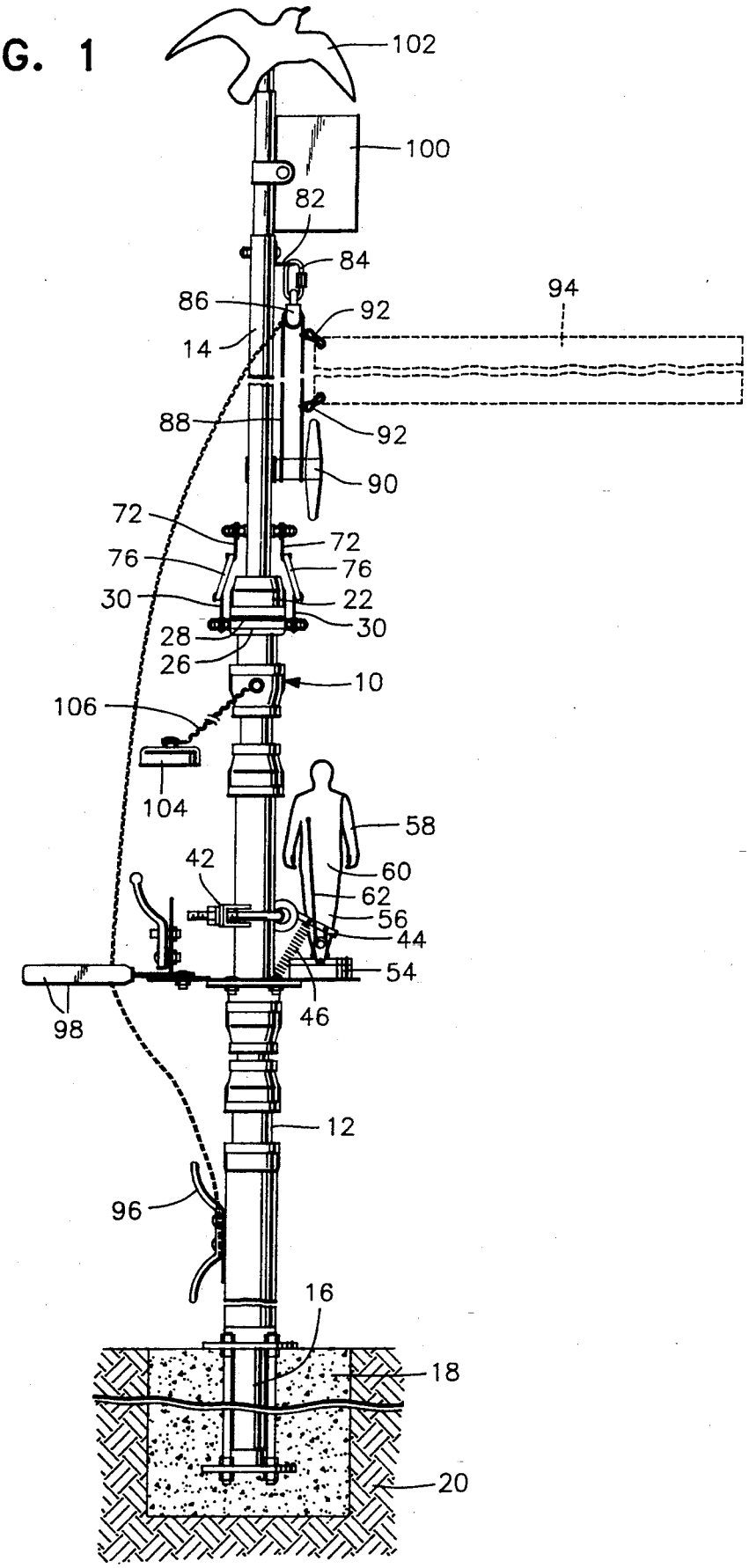
FIG. 1 is a fragmentary side elevational view of the flagstaff of the instant invention with an associated flag and an alternate position of the halyard illustrated in phantom lines.

Referring now more specifically to the drawings, the numeral 10 generally designates the flagstaff of the instant invention. The flagstaff includes numerous threadedly interconnected pipes but in fact incorporates a lower end portion 12 and an upper end portion 14. The lower end portion 12 is of a contour structure, as at 16 shown in FIG. 1, enabling it to be readily stationarily embedded in cementious material 18 within the ground 20. Inasmuch as the lower end portion is constructed of various interconnected pipe sections, it is tubular and includes an upper end tubular fitting 22 defining a downwardly facing abuttment surface 24. An anchor collar 26 is loosely slideably and rotatably received on the lower end portion 12 immediately beneath the fitting 22 and an anti-friction washer 28 is disposed about the lower end portion 12 between the anchor collar 26 and the abuttment surface 24.

Diametrically opposite portions of the anchor collar 26 have inverted J-shaped hooks 30 pivotably supported therefrom as at 32 for rotation about a diametric axis of the anchor collar 26 and the interior of the lower end portion 12 defines an upwardly facing annular abutment surface 34. A tubular actuator rod 36 is slideably telescoped down into the lower end portion 12 through the fitting 22 and abuts against one arm end 38 of a coil member 40 mounted on the exterior of the lower end portion 12 through the utilization of a U-shaped clamp assembly 42. The coil member 40 includes a second arm end 44 which extends outwardly from the lower end portion 12 and has one end of an expansion spring 46 anchored thereto as at 48. The other end of the expansion spring 46 is anchored to an annular mount 50 mounted on the lower end portion 12 a spaced distance below the clamp assembly 42. The lower end portion 12 includes a window 52 therein through which a portion of the coil member projects as well as the first arm end 38.

Figure 3:
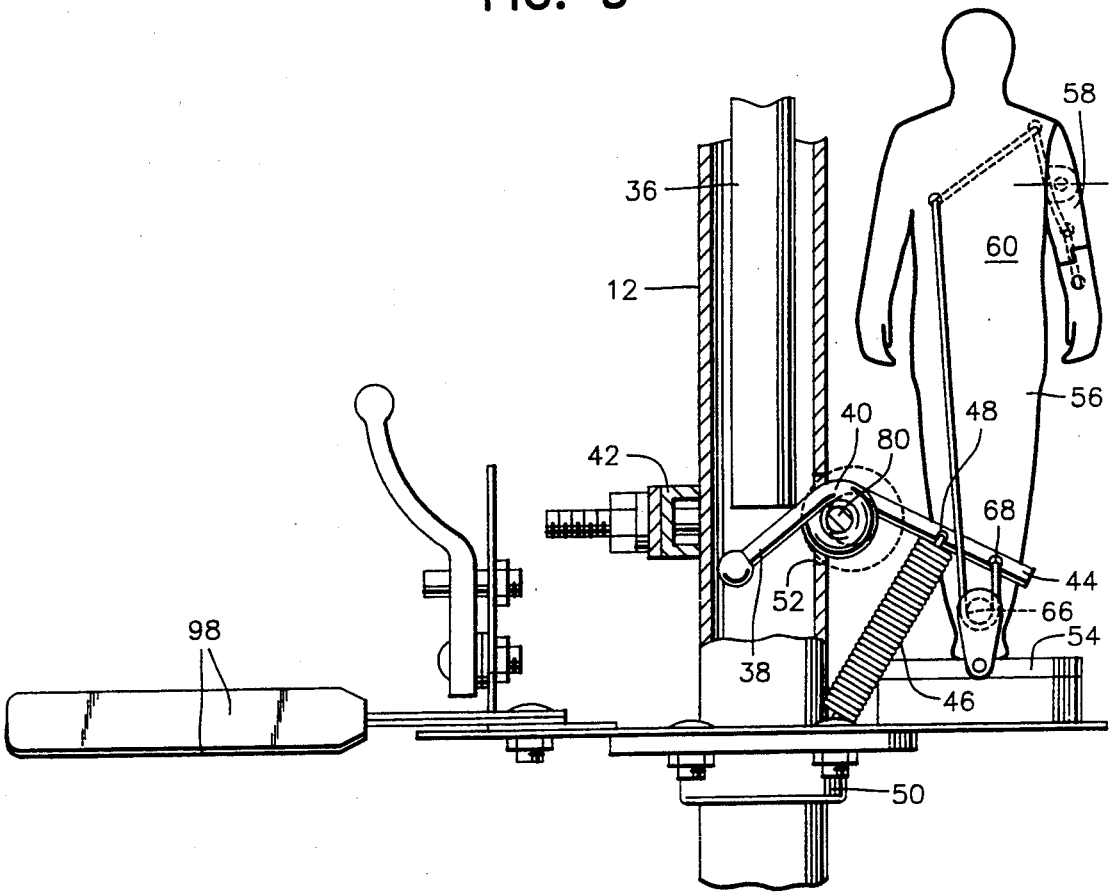
FIG. 3 is a an enlarged fragmentary side elevational view of an upper portion of the lower end portion of the flagstaff from which the human simulating figure is supported, parts of the lower end portion of the flagstaff being broken away and illustrated in vertical section.
Figure 4:
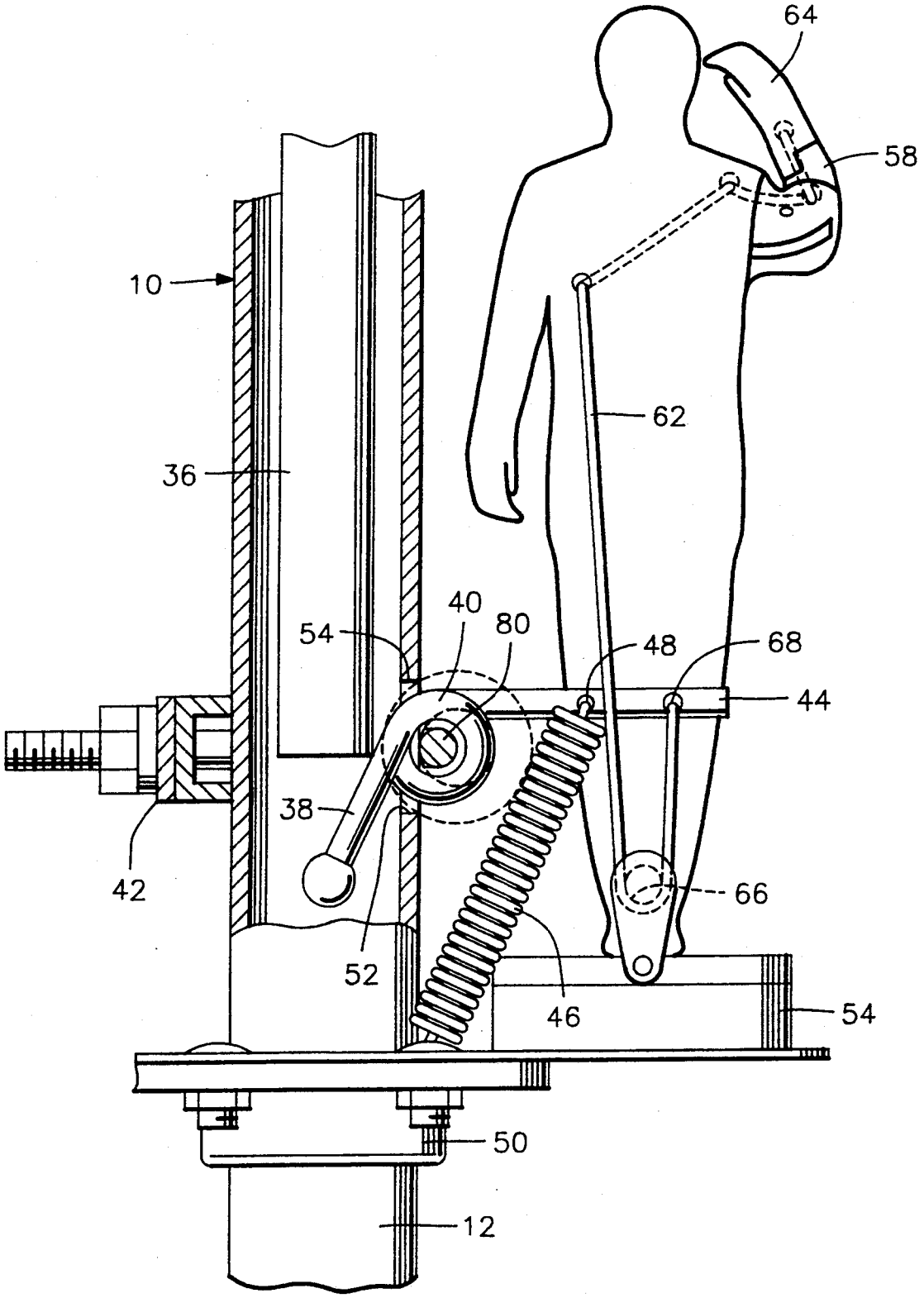
FIG. 4 is a further enlarged fragmentary elevational view similar to FIG. 3 but illustrating the human simulating figure in hand salute position.

The annular mount supports the base 54 of a human simulating FIG. 56 including an articulated arm 58 which is movable between a downwardly directed position such as that illustrated in FIG. 3 extending along the corresponding side of the body 60 of the FIG. 56 and a raised hand salute position such as that illustrated in FIG. 4.

A tether member 62 is provided and has one end portion thereof anchored to the hand 64 of the arm 58 and the other end passes downwardly about a pulley 66 and is anchored to the arm end 44 as at 68. As may be seen from FIGS. 3 and 4 of the drawings, the tension member 62 passes through several bores formed in the body 60 and also the arm 58 in a manner such that a downward pull on the tension member 62 by the arm end 44 being swung upwardly from the lower position thereof illustrated in FIG. 3 to the raised position thereof illustrated in FIG. 4 will cause the arm 58 to be pulled upward from the downwardly directed position in FIG. 3 to the hand salute position of FIG. 4.

The upper end of the tubular abuttment rod 36 is telescoped upwardly and secured within the lower end of the upper end portion 14 and the upper end of a compression spring 70 abuts the lower end of the upper end portion 14 while the lower end of spring 70 abuts the abuttment surface 34. Further, the upper end portion 14 includes a pair of J-shaped hooks 72 corresponding to the hooks 30 pivotally achored thereto as at 74 and a pair of rings 76 are releaseably connected between corresponding pairs of hooks 30 and 72 to maintain the tubular abutment rod 36 in a downwardly displaced position against the biasing action of the spring 70 when the lower end of the upper end portion 14 is telescoped downwardly into the upper end of the lower end portion 12.

When the upper end portion 14 and the tubular abutment rod 36 are initially downwardly telescoped into the upper end of the lower end portion 12 and before the spring 70 is compressed, the lower end of the tubular abutment rod 36 rests upon the arm end 38 in the manner illustrated in FIG. 3 of the drawings. However, when downward pressure is applied to the upper end portion 14 and it is downwardly displaced against the biasing action of the spring 70 and latched in a lowered position through the ulitilization of the hooks 30 and 72 and the rings 76, the lower end of the tubular abutment rod 36 downwardly displaces the arm end 38 from the position thereof illustrated in FIG. 3 to the position thereof illustrated in FIG. 4 thus causing the coil member 40 to be angularly displaced about the bight portion 80 of the clamp assembly 42 to the position thereof illustrated in FIG. 4 thus causing the arm 58 to move upwardly from the downwardly directed position of FIG. 3 to the hand salute position of FIG. 4.

The upper end portion 14 includes a bracket 82 from which an openable hasp 84 is loosely supported and the hasp 84 supports a pulley 86 therefrom about which a halyard 88 is passed, the halyard 88 also being passed about a lower anchor 90 carried by the upper end portion 14. The halyard 88 includes a pair openable hooks 92 supported therefrom by which a flag 94 may be mounted from the halyard 88. Of course, the halyard 88 is utilized to raise and lower the flag 94 relative to the upper end portion. If it is desired not to use the anchor 90, a lower anchor 96 is mounted upon the lower end portion 12 and the halyard 88 may pass downwardly along the flagstaff 10 and between a pair of outwardly divergent arms 98 carried by the anchor member 50. Still further, the upper end portion 14 includes a small wind vane 100 supported therefrom which may be suitably decorated if desired and the upper terminal end of the upper end portion 14 may include an ornament such as an eagle in flight.

The lower end portion 12 also includes a cap 104 loosely tethered thereto as at 106 and when the upper end portion withdrawn from the lower end portion 12, the cap 104 may be secured over the upper end of the tubular fitting 22.

After the upper end portion 14 has been removed from the lower end portion 12, it may be held in a horizontal position and rotated about its center axis. In this manner, the flag 94 may be rolled about the upper end portion.

Figure 2:
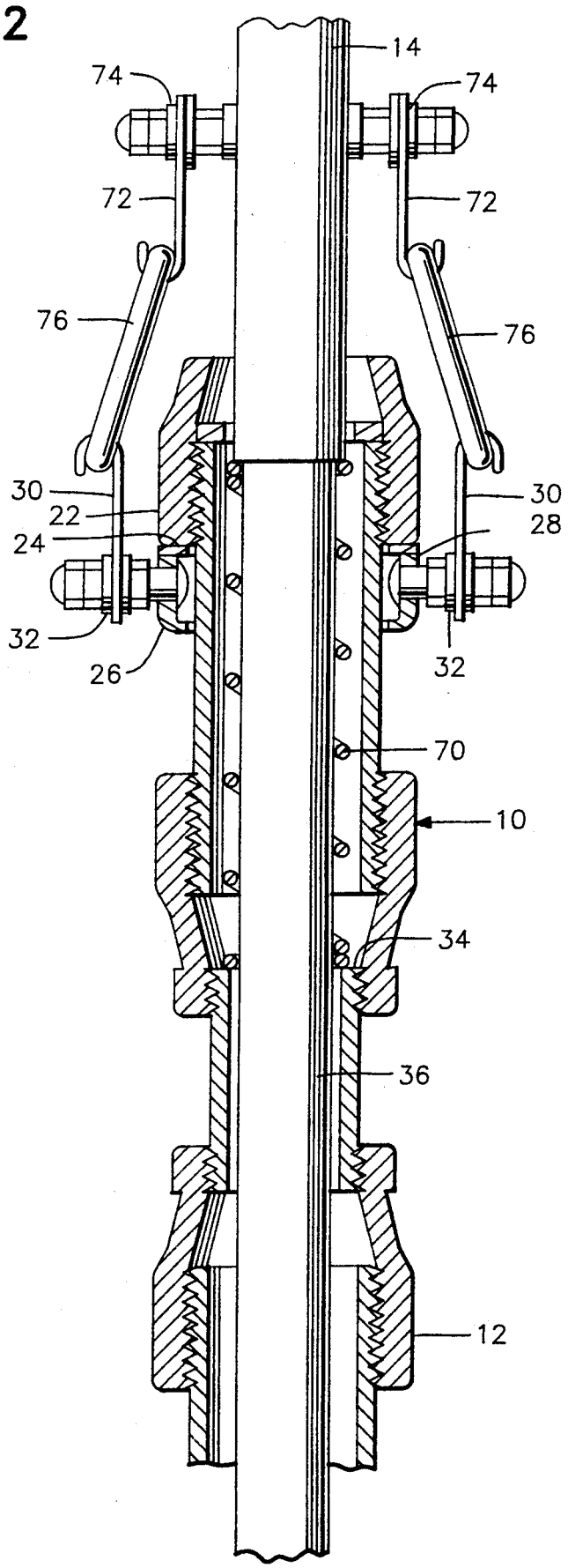
FIG. 2 is an enlarged fragmentary vertical sectional view of the adjacent relatively telescopingly engaged upper and lower end portions of the flagstaff.

Of course, when the upper end portion including the tubular abutment rod 36 is upwardly withdrawn from the upper end of the lower end portion 12, the expansion spring 46 pulls downwardly on the arm end 44 to thereby place slack in the tension member 62 and the weight of the arm 58 will cause the latter to swing, by gravity, downwardly from the hand salute position illustrated in FIG. 4 to the lowered position illustrated in FIGS. 1 and 2.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flagstaff including upper and lower end portions each having upper and lower ends, said lower end of said lower end portion being adapted to be stationarily supported and at least the upper end of said lower end portion being tubular, the lower end of said upper end portion being removably telescoped and rotationally received in said lower end portion upper end to a lower limit position, said upper end portion including lanyard means adjustably supported therefrom for supporting a flag from said upper end portion and raising and lowering said flag along said upper end portion, means in said lower end portion yieldingly biasing said upper end portion upwardly relative to said lower end portion from said lower limit position toward a raised position with the lower end of said upper end portion still telescoped into and rotatably received in said lower end portion upper end, first and second coacting exterior rotary coupling means carried by said upper and lower end portions releasably latching said upper end portion to said lower end portion with said upper end portion still rotatable relative to said lower end portion.

2. The flagstaff of claim 1 wherein said lower end portion includes a human simulating figure thereon including an articulated right arm shiftable between a downwardly extending, along the corresponding body side, position and a hand salute position, biasing means yieldingly biasing said right arm toward said downwardly extending position, and actuating means in said lower end portion engageable by the lower end of said upper end portion upon being downwardly inserted into said upper end of said lower end portion toward said lowered limit position from said raised position to overcome said biasing means and move said articulated right arm from said lowered position to said hand salute position.

3. The flagstaff of claim 2 wherein said upper end portion lower end includes independently useable first halyard anchoring means thereon.

4. The flagstaff of claim 3 wherein said lower end portion includes independently useable second halyard anchoring means thereon.

5. The flagstaff of claim 1 wherein said upper end portion includes independently useable first halyard anchoring means thereon.

6. The flagstaff of claim 5 wherein said lower end portion includes independently useable second halyard anchoring means thereon.

7. The flagstaff of claim 1 wherein the upper end of said upper end portion includes small wind vane means stationarily mounted thereon.

8. The flagstaff of claim 1 wherein the upper end of said lower end portion includes a cap loosely tethered thereto and removably engageable over the upper end of said lower end portion when said upper end portion is removed from said lower end portion.

9. The flagstaff of claim 1 wherein said lower end of said lower end portion is of a contour to be stationarily embedded in cementious material.

* * * * *